US009139001B2

(12) United States Patent
Sung et al.

(10) Patent No.: US 9,139,001 B2
(45) Date of Patent: Sep. 22, 2015

(54) INKJET PRINT HEAD AND METHOD FOR MANUFACTURING THE SAME

(71) Applicant: SAMSUNG DISPLAY CO., LTD., Yongin, Gyeonggi-Do (KR)

(72) Inventors: Woo-Yong Sung, Seoul (KR); A-Ram Lee, Hwaseong-si (KR); Tae-Gyun Kim, Seoul (KR); Tae-Woon Cha, Seoul (KR); Sang-Gun Choi, Suwon-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 157 days.

(21) Appl. No.: 13/680,026

(22) Filed: Nov. 17, 2012

(65) Prior Publication Data

US 2013/0342607 A1 Dec. 26, 2013

(30) Foreign Application Priority Data

Jun. 21, 2012 (KR) ..... 10-2012-0066519

(51) Int. Cl.
*B41J 2/14* (2006.01)
*B41J 2/16* (2006.01)

(52) U.S. Cl.
CPC ..... *B41J 2/1433* (2013.01); *B41J 2/1404* (2013.01); *B41J 2/14072* (2013.01); (Continued)

(58) Field of Classification Search
CPC ..... B41J 2/14072; B41J 2/26; B41J 2/164; B41J 2/1642; B41J 2/1643; B41J 2/1645; B41J 2/1646
USPC ..... 347/47, 50; 427/475, 497, 509, 582, 427/585, 901; 29/890.01, 890.142
See application file for complete search history.

(56) References Cited

U.S. PATENT DOCUMENTS 5,711,987 A * 1/1998 Bearinger et al. ..... 427/7
5,812,158 A * 9/1998 Murthy et al. ..... 347/45

(Continued)

FOREIGN PATENT DOCUMENTS

JP 06238897 A 8/1994
JP 3904439 B2 1/2007
KR 101109923 B1 1/2012

OTHER PUBLICATIONS

Li et al., Room-Temperature Fabrication of Anodic Tantalum Pentoxide for Low-Voltage Electrowetting on Dielectric (EWOD), Journal of Microelectromechanical Systems, vol. 17, No. 06, p. 1481-1488.*

(Continued)

*Primary Examiner* — Matthew Luu
*Assistant Examiner* — Partick King
(74) *Attorney, Agent, or Firm* — Cantor Colburn LLP

(57) ABSTRACT

An inkjet print head includes a jet assembly, a printed-circuit board and a barrier coating film. The jet assembly includes a nozzle plate including a jet orifice in a lower surface of the nozzle plate and through which ink is discharged, and an ink transfer pathway inside nozzle plate. The printed-circuit board is combined with the jet assembly. The printed-circuit board includes an integrated circuit and a connection electrode. The barrier coating film includes organic material, a flexible layer and a hydrophobic layer. The barrier coating film covers an inner and an outer surface of the jet assembly, and an outer surface of the printed-circuit board. The barrier coating film exposes the lower surface of the nozzle plate and an outer surface of the connection electrode.

11 Claims, 10 Drawing Sheets

(52) U.S. Cl.
CPC ..... *B41J 2/14145* (2013.01); *B41J 2/162* (2013.01); *B41J 2/1603* (2013.01); *B41J 2/1642* (2013.01); *B41J 2/1643* (2013.01); *B41J 2/1408* (2013.01); *B41J 2/14032* (2013.01); *Y10T 29/49401* (2015.01)

(56) References Cited

U.S. PATENT DOCUMENTS

| | | | | |
|---|---|---|---|---|
| 8,033,645 | B2 * | 10/2011 | Van Den Berg et al. | 347/47 |
| 8,112,889 | B2 * | 2/2012 | Bich et al. | 29/890.1 |
| 2002/0097297 | A1 * | 7/2002 | Skinner et al. | 347/46 |
| 2003/0184616 | A1 * | 10/2003 | Yang et al. | 347/47 |
| 2004/0179064 | A1 * | 9/2004 | Zapka et al. | 347/47 |
| 2006/0066672 | A1 * | 3/2006 | Park et al. | 347/47 |
| 2008/0043068 | A1 * | 2/2008 | Oya et al. | 347/70 |
| 2008/0084451 | A1 * | 4/2008 | Arawaka et al. | 347/45 |
| 2008/0088678 | A1 * | 4/2008 | Watanabe | 347/68 |
| 2009/0303288 | A1 * | 12/2009 | Nakajima et al. | 347/47 |
| 2010/0110136 | A1 * | 5/2010 | Drury et al. | 347/18 |
| 2011/0050803 | A1 * | 3/2011 | Wu et al. | 347/44 |
| 2011/0090289 | A1 * | 4/2011 | Mizukami | 347/68 |
| 2011/0126730 | A1 * | 6/2011 | Berniard et al. | 101/483 |
| 2011/0175967 | A1 * | 7/2011 | Machida et al. | 347/54 |
| 2012/0092424 | A1 * | 4/2012 | Fox et al. | 347/71 |

OTHER PUBLICATIONS

Li et al., Room-Temperature Fabrication of Anodic Tantalum Pentoxide for Low-Voltage Electrowetting on Dielectric (EWOD) Journal of Microelectromechanical Systems, vol. 17, No. 06, p. 1481-1488 (2008).*

* cited by examiner

INKJET PRINT HEAD AND METHOD FOR MANUFACTURING THE SAME

This application claims priority to Korean Patent Application No. 10-2012-0066519, filed on Jun. 21, 2012, and all the benefits accruing therefrom under 35 U.S.C. §119, the contents of which are herein incorporated by reference in their entireties.

BACKGROUND

1. Field

Exemplary embodiments of the invention relate to an inkjet print head and a method of manufacturing the inkjet print head. More particularly, exemplary embodiments of the invention relate to an inkjet print head and a method of manufacturing the inkjet print head of an industrial inkjet printer.

2. Description of the Related Art

Generally, an inkjet print head serves to convert electric signals to a physical force, and to discharge an ink such as in a droplet shape through a plurality of small nozzles. The type of the inkjet print head may be based on a method of discharging the ink. Particularly, a piezo-electric type inkjet print head which uses piezo-electricity to discharge an ink, has been used in industrial inkjet printers. For example, the piezo-electric type inkjet printer head has been used to jet ink including metals such as gold or silver onto a flexible printed-circuit board ("FPCB") for forming a circuit pattern, to deposit a liquid crystal used in industrial graphics or in a liquid crystal display device ("LCD"), and to apply materials in the manufacture of an organic light emitting diode or a solar cell.

An ink transfer pathway is formed by each nozzle of the inkjet print head, and droplet-shaped inks provided from each ink transfer pathway, are discharged by each nozzle. A portion of the inks passed through the inkjet print head may not be discharged from the inkjet head, such that the inks are undesirably adsorbed or remain within the inkjet print head, or materials of inkjet print head are undesirably mixed with the inks. Thus, a pollution of discharged ink may be generated.

SUMMARY

One or more exemplary embodiment of the invention provides an inkjet print head to have a low hygroscopic property and high durability.

One or more exemplary embodiment of the invention also provides a method of manufacturing the inkjet print head.

According to an exemplary embodiment of the invention, the inkjet print head includes a jet assembly including a nozzle plate including a jet orifice on a lower surface of the nozzle plate and through which an ink is discharged from the nozzle plate, and an ink transfer pathway inside the nozzle plate; a printed-circuit board which is combined with the jet assembly, the printed-circuit board including an integrated circuit and a connection electrode; and a first barrier coating film including an organic material, a flexible layer and a hydrophobic layer. The first barrier coating film covers an inner surface and an outer surface of the jet assembly, and an outer surface of a portion of the printed-circuit board. The first barrier coating film exposes the lower surface of the nozzle plate and an outer surface of the connection electrode of the printed-circuit board.

In an exemplary embodiment, the flexible layer of the first barrier coating film may include a parylene film or parylene.

The parylene may include at least one selected from parylene C, parylene N, parylene D and parylene HF.

In an exemplary embodiment, a thickness of the flexible layer may be about 0.1 micron (μm) to about 10 μm.

In an exemplary embodiment, the hydrophobic layer may include a self assembly monolayer ("SAM").

In an exemplary embodiment, the hydrophobic layer may include a material which has a contact angle of about 90 degrees to about 130 degrees based on deionized water (DI water).

In an exemplary embodiment, a thickness of the hydrophobic layer may be about 30 angstroms (Å) to about 100 Å.

In an exemplary embodiment, the first barrier coating film may be on an inner surface of the ink transfer pathway, on an inner surface of the jet orifice and on an outer surface of a portion of the printed-circuit board including the integrated circuit, the portion being combined with the jet assembly.

In an exemplary embodiment, the first barrier coating film may cover all jet assembly inner surfaces that contact the ink.

In an exemplary embodiment, the inkjet print head further includes a second barrier coating film including the flexible layer of the barrier coating film. The second barrier coating film may be disposed on the lower surface of the nozzle plate.

According to another exemplary embodiment of the invention, a method of manufacturing an inkjet print head is provided. In the method, a jet assembly is combined with a printed-circuit board to provide a print head assembly. A first mask pattern covering a connection electrode of the printed-circuit board is provided. A flexible layer including an organic material, on inner and outer surfaces of the print head assembly including the first mask pattern thereon. A second mask pattern covering a lower surface of a nozzle plate of the jet assembly is provided. A hydrophobic layer including an organic material is provided on the flexible layer and the second mask pattern. The first and second mask patterns are removed to form a barrier coating film including the flexible layer and the hydrophobic layer, on the inner and outer surfaces of the print head assembly.

In an exemplary embodiment, the flexible layer may be provided by deposition of parylene.

In an exemplary embodiment, the hydrophobic layer may be provided by deposition of a SAM.

In an exemplary embodiment, the hydrophobic layer may be provided by liquid phase deposition or vapor phase deposition.

In an exemplary embodiment, the flexible layer and the hydrophobic layer may be formed at about 10 degrees Celsius (° C.) to about 100° C.

According to another exemplary embodiment of the invention, a method of manufacturing an inkjet print head is provided. In the method, a print head assembly of provided by combining a jet assembly and a printed-circuit board. A mask pattern covering on a lower surface of a nozzle plate of the jet assembly and a connection electrode of the printed-circuit board is provided. A flexible layer including an organic material is provided on inner and outer surfaces of the print head assembly including the mask pattern thereon. A hydrophobic layer including an organic material is provided on the flexible layer and the second mask pattern. The mask pattern is removed to form a barrier coating film including the flexible layer and the hydrophobic layer, on the inner and outer surfaces of the print head assembly.

In an exemplary embodiment, the flexible layer may be provided by deposition of parylene.

In an exemplary embodiment, the hydrophobic layer may be provided by deposition of a SAM.

In an exemplary embodiment, the hydrophobic layer may be provided by liquid phase deposition or vapor phase deposition.

In an exemplary embodiment, the flexible layer and the hydrophobic layer may be formed at about 10° C. to about 100° C.

According to one or more exemplary embodiment of the invention, the inkjet print head includes a barrier film including an organic material, and the barrier film may cover inner and outer surfaces of the inkjet print head. The barrier film reduces or effectively prevents absorption of an ink which flows inside the print head to a surface of members of the print head. Also, the barrier film reduces or effectively prevents undesirable particles from the members of the print head from mixing with the ink which flows inside the print head. Thus, one or more exemplary embodiment of the inkjet print head has increased durability by providing the barrier film on inner and outer surfaces of the inkjet print head.

Even though a barrier film is provided in the inkjet print head, performance of the inkjet print head may be maintained. The barrier film includes a flexible layer, so that a crack in the barrier film may be reduced or effectively prevented.

BRIEF DESCRIPTION OF THE DRAWINGS

The above and other features and advantages of the invention will become more apparent by describing in detailed exemplary embodiments there of with reference to the accompanying drawings, in which.

DETAILED DESCRIPTION

Figure 1A:
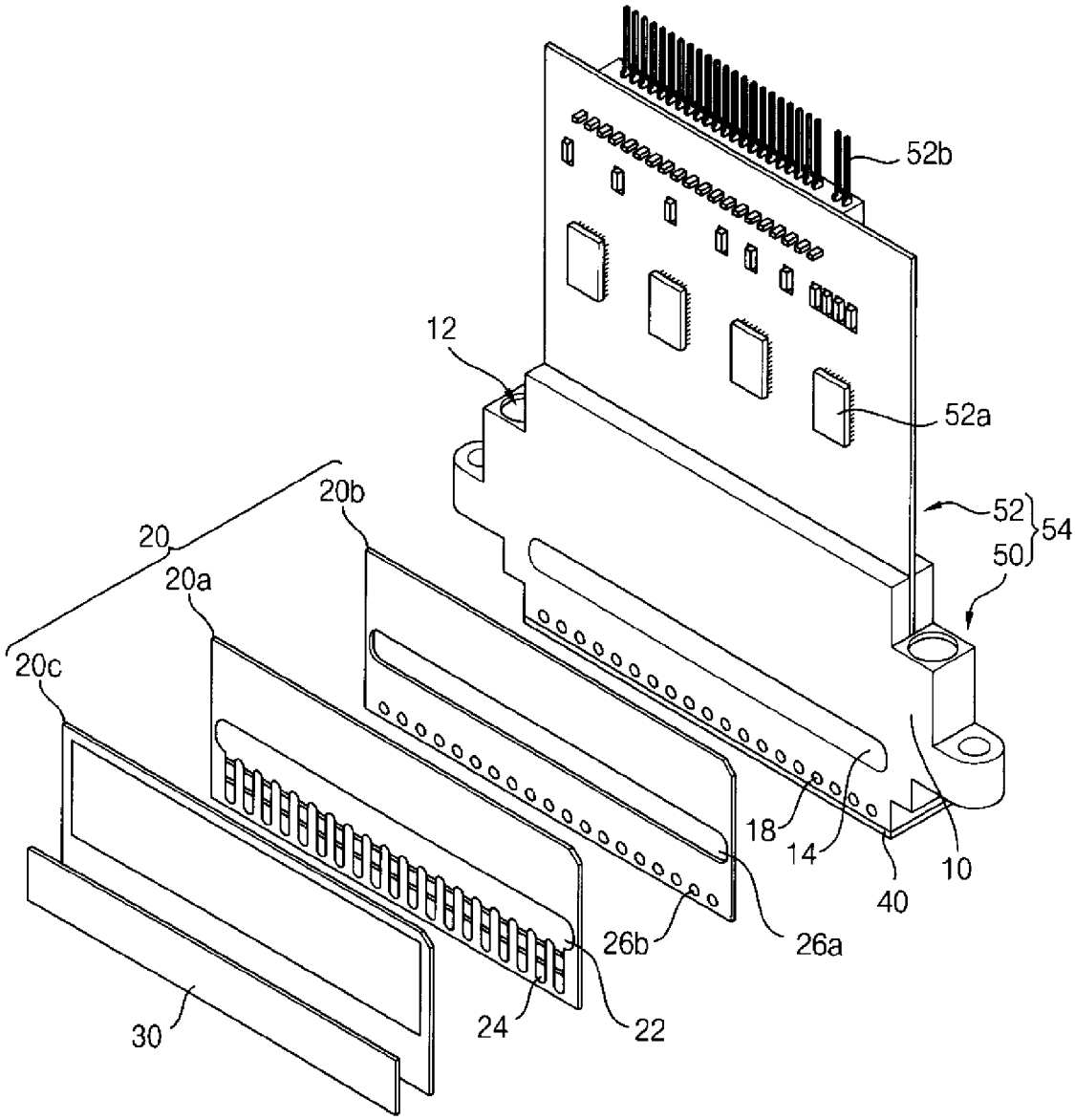
FIG. 1A is an exploded perspective view schematically illustrating an exemplary embodiment of an inkjet print head according to the invention.

It will be understood that when an element or layer is referred to as being "on" or "connected to" another element or layer, the element or layer can be directly on or connected to another element or layer or intervening elements or layers. In contrast, when an element is referred to as being "directly on" or "directly connected to" another element or layer, there are no intervening elements or layers present. As used herein, connected may refer to elements being physically and/or electrically connected to each other. Like numbers refer to like elements throughout. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "lower," "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises," "comprising," "includes" and/or "including," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, exemplary embodiments of the invention will be described in detail with reference to the accompanying drawings.

Figure 1B:
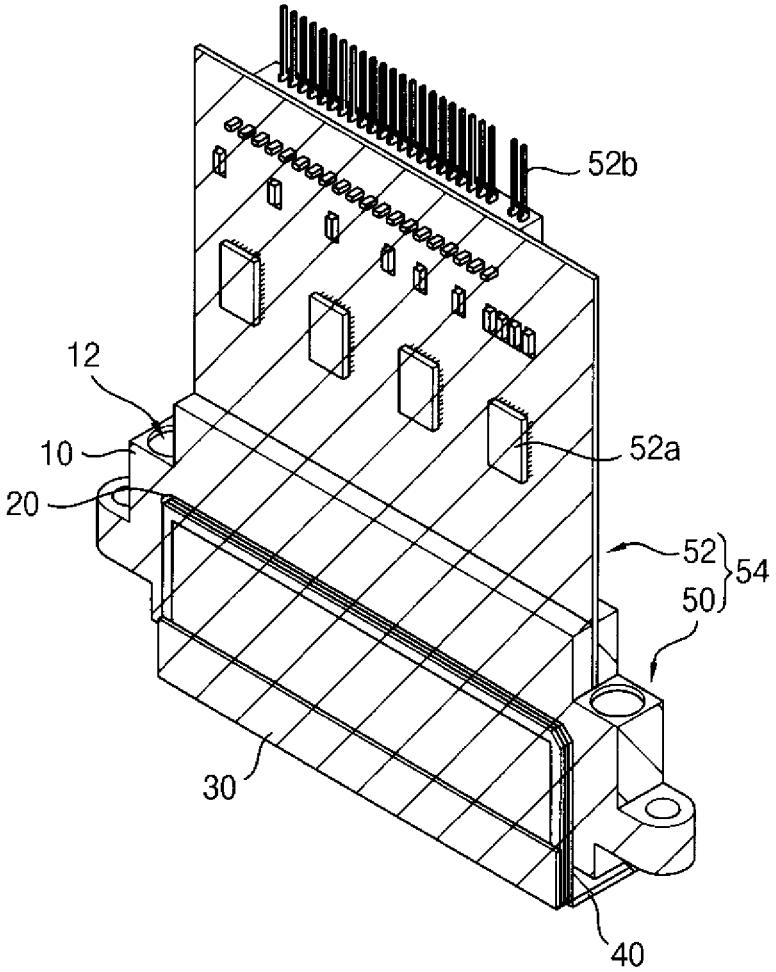
FIG. 1B is a perspective view illustrating the inkjet print head of FIG. 1A according to the invention.
Figure 2A:
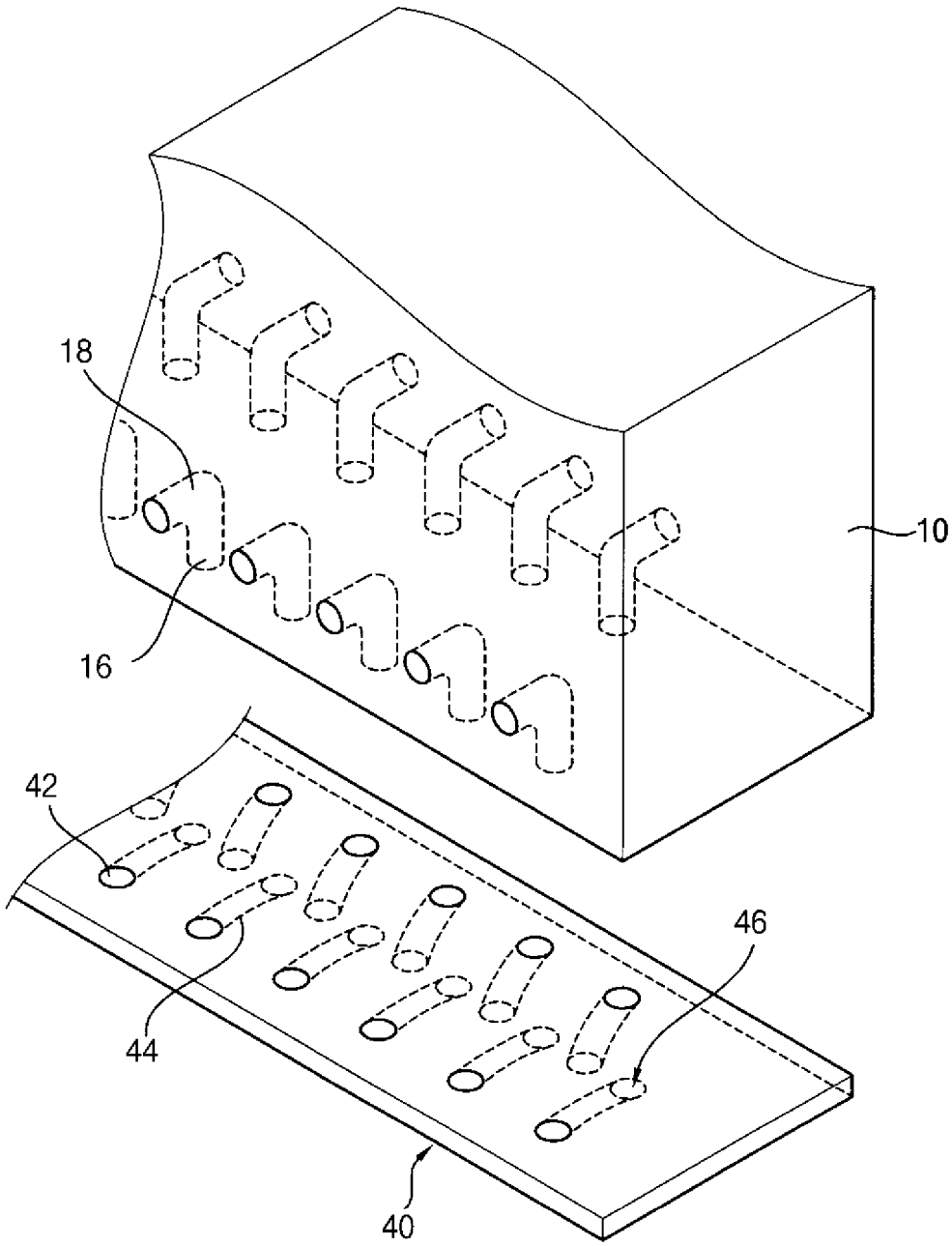
FIG. 2A is an exploded perspective view schematically illustrating an exemplary embodiment of a portion of the inkjet print head in FIG. 1A.
Figure 2B:
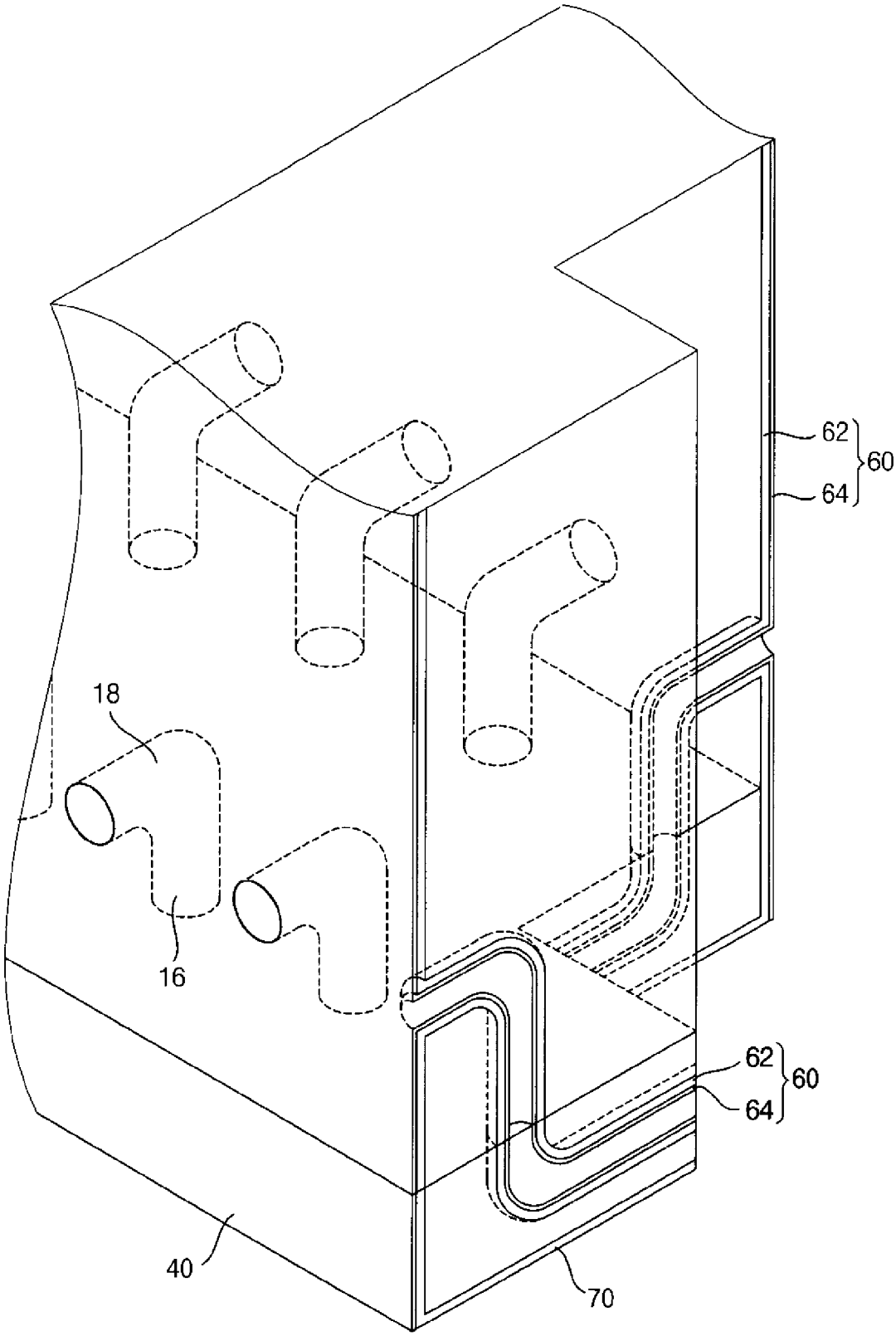
FIG. 2B is a perspective view schematically illustrating the portion of the print head in FIG. 1B.

FIG. 1A is an exploded perspective view schematically illustrating an exemplary embodiment of an inkjet print head according to the invention. FIG. 1B is a perspective view illustrating the inkjet print head of FIG. 1A. FIG. 2A is an exploded perspective view schematically illustrating an exemplary embodiment of portion of the inkjet print head in FIG. 1A. FIG. 2B is a perspective view schematically illustrating the portion of the print head in FIG. 1B.

A barrier coating film is not illustrated in FIGS. 1A and 2A.

Referring to FIGS. 1A to 2B, the inkjet print head includes a print head assembly 54, a first barrier coating film 60 inside the print head assembly 54 and a second barrier coating film 70 outside the print head assembly 54. The print head assembly 54 includes a jet assembly 50 and a printed-circuit board 52. A material used in or jetted from the inkjet print head may be an ink including a metal such as gold or silver, or may be a liquid crystal used in a liquid crystal display apparatus, but is not limited thereto or thereby.

The jet assembly 50 includes a body 10, a combined board assembly 20 attached on one side or both of opposing sides of the body 10, a nozzle plate 40 disposed on bottom of the body 10, and a piezo-electric element 30. The printed-circuit board 52 includes an integrated circuit 52*a* and a connection electrode 52*b*.

The body 10 of the jet assembly 50 may include carbon or silicon, but is not limited thereto or thereby. The body 10 may have a longitudinal axis in a first direction. An ink inlet 12 into which an ink or other material flows is disposed at an end portion of the body 10. The ink inlet 12 may be provided in plural, such as being disposed at both of opposing end portions of the body 10, but is not limited thereto or thereby. An ink refill pathway 14 stories inks from the ink inlet 12, and is disposed inside the body 10 of the jet assembly 50. The ink refill pathway 14 may have a longitudinal axis substantially parallel to the longitudinal axis of the body 10.

Referring to FIGS. 2A and 2B, a first opening 16 may be disposed on a bottom of the body 10. The first opening 16 may be provided in plural, but is not limited thereto or thereby. The jet assembly 50 may include more than two hundred first openings 16, for example, two hundred fifty-six first openings 16 may be disposed at the bottom of the body 10.

The first openings 16 may be disposed in only one row, or may be disposed or in two or more rows, the rows being extended in the first direction along the bottom of the body 10. The first opening 16 is in fluid connection with a passage 18 disposed inside the body 10. A first end of the passage 18 is exposed to outside the body 10 by the first opening 16 extended through the bottom surface of the body 10. A second end of the passage 18 is exposed to outside the body 10 by a second opening extended through a side surface of the body 10, where the side surface is adjacent to the bottom surface. That is, the passage 18 is accessible from two different planes of the body 10.

The combined board assembly may be disposed on each of a front side and back side of the body 10. For convenience, the combined board assembly 20 is shown only on the front side of the body 10.

The combined board assembly 20 is a member forming an ink transfer pathway which provides ink from the ink refill pathway 14 of the body 10 to the first openings 16 at the bottom surface of the body 10. The combined board assembly 20 may include a joining board 20*a*, a reinforcing board 20*b* attached on a first side of the joining board 20*a* facing the body 10, and a polymer film 20*c* attached on a second side of the joining board 20*a* opposite to the first side.

The joining board 20*a* may include a first joining member 22 disposed opposite to and facing the ink refill pathway 14, and a plurality of second joining members 24. The second joining members 24 are vertically extended in a lower part of the joining board 20*a* and are in fluid connection with the first joining member 22. A size and position of the first joining member 22 in the joining board 20*a* is substantially the same as a size and position of the ink refill pathway 14 in the body 10. Also, the second joining member 24 may be closed at the second side of the joining board 20*a*. End portions of the second joining member 24 may be in fluid connection with each other within the joining board 20*a*. A first end portion of the second joining member 24 may be fluidly connected to a passage 18 opened at the side surface of the body 10. A second end portion of the second joining member 24 may be fluidly connected to the reinforcing board 20*b*.

The reinforcing board 20*b* is disposed between the joining board 20*a* and the body 10. The reinforcing board 20*b* may include a third joining member 26*a* disposed in opposite to and facing the ink refill pathway 14, and a hole 26*b* opposite to and facing the second end portion of the second joining member 24.

The polymer film 20*c* may cover and overlap the first surface of the joining board 20*a*. The polymer film 20*c* includes flexibility, such that deformation or transformation of Other members of the inkjet print head by piezo-electric element 30 is reduced or effectively prevented. The polymer film 20*c* may include polyimide, but is not limited thereto or thereby.

As discussed above, the combined board assembly 20 includes the joining board 20*a*, the reinforcing board 20*b* and the polymer film 20*c* assembled together, such as being respectively in contact with each other. Each of the first to third joining members 22, 24 and 26*a* and the hole 26*b* of the combined board assembly 20 are in fluid communication to form the ink transfer pathway. Stored inks from the ink refill pathway 14 of the body 10 reenter the body 10 through the passages 18 at the side surface of the body 10. The stored inks sequentially pass through the third joining member 26*a*, the first joining member 22, the second joining member 24 and the hole 26*b* of the combined board assembly 20. The inks which have reentered the body 10 from the combined board assembly 20 may be discharged via the passages 18 in fluid connection with the combined board assembly 20 and the first openings 16 open at the bottom surface of the body 10.

The piezo-electric element 30 is attached to a side of the joint board-combination body 20. The piezo-electric element 30 is attached an on outer surface of the polymer film 20*c*. The piezo-electric element 30 may be disposed on both a front side and a back side of the body 10. Actuation or operation of the piezo-electric element 30 pumps transfers ink through an ink transfer pathway in the combined board assembly 20.

The nozzle plate 40 may be attached on the bottom surface of the body 10. The nozzle plate 40 may include silicon, but is not limited thereto or thereby. The nozzle plate 40 includes second openings 42 extended through an upper surface of the nozzle plate 40. The second openings 42 are in fluid connection with and/or aligned with the first openings 16 of the body 10. Also, the nozzle plate 40 includes channels 44 respectively in fluid connection with the second openings 42, so that inks from the combined board assembly 20 may be transferred through the nozzle plate 40 via the channels 44. Each of the channels 44 is connected with the second openings 42, but only a portion of the channels 44 is illustrated for convenience.

The nozzle plate 40 further includes a jet orifice 46 extended through a lower surface of the nozzle plate 40. The jet orifice 46 is respectively in fluid connection with a channel 44. Inks from the combined board assembly 20 may be finally discharged outside the inkjet print head via the jet orifice 46.

Referring to FIG. 1B, members of the jet assembly 50 may be attached to each other by an adhesive member, such as an epoxy resin, but is not limited thereto or thereby. Thus, the epoxy resin may be exposed at end portion of the combined jet assembly 50.

The first barrier coating film (hatching portion in FIG. 1B) serves to reduce or effectively prevent ink or particles from flowing into fine holes of an inner surface of the jet assembly 50, and serves to improve a durability of the printed-circuit board 52.

The first barrier coating film 60 may cover all inner and outer surfaces of the print head assembly 54 including the jet assembly 50 and the printed-circuit board 52 combined with each other, except for a bottom surface of the nozzle plate 40 and the connection electrode 52*b* extending outside of a portion of the printed-circuit board 52 which is combined with the jet assembly 50. Thus, the first barrier coating film 60 may have a profile corresponding to an overall shape of an inside and/or an outside of the inkjet print head.

Hereinafter, a structure of the first barrier coating film 60 will be described in detail.

Figure 3A:
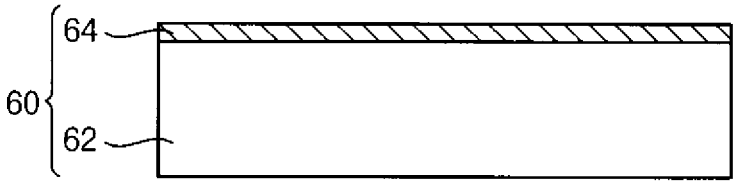
FIG. 3A is a cross-sectional view illustrating an exemplary embodiment of a structure of a first barrier coating film in FIG. 2B.
Figure 3B:
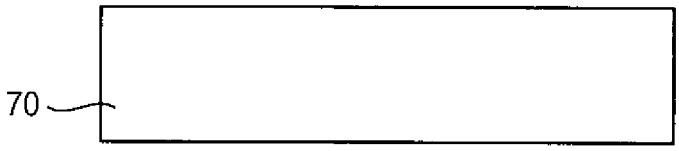
FIG. 3B is a cross-sectional view illustrating a structure of a second barrier coating film in FIG. 2B.

FIG. 3A is a cross-sectional view illustrating an exemplary embodiment of a structure of the first barrier coating film in FIG. 2B. FIG. 3B is a cross-sectional view illustrating an exemplary embodiment of a structure of the second barrier coating film 70 in FIG. 2B.

Referring to FIG. 3A, the first barrier coating film 60 includes an organic material. The first barrier coating film 60 may include a flexible layer 62 and a hydrophobic layer 64. One or both of the flexible layer 62 and the hydrophobic layer 64 includes an organic material. The hydrophobic layer 64 is a top film of the first barrier coating film 60 exposed to an outside of the first barrier coating film 60.

The flexible layer 62 is a lower film of the first barrier coating film 60 and contact members of the print head assembly 54. The flexible layer 62 serves to reduce or effectively prevent deformation or transformation of members of the print head assembly 54 by pressure and vibration in jetting ink which may generate a crack. Thus, the flexible layer 62 on members of the print head assembly 54 may improve a durability of the print head assembly 54. Also, a surface of the members of the print head assembly 54 may be planarized by the flexible layer 62. In contrast, when a print head assembly includes the hydrophobic layer 64 but does not include the flexible layer 62, durability of the print head assembly may decrease.

In order to prevent a change in characteristics of the members of the jet assembly 54 and the printed-circuit board 52 such as by heat, the flexible layer 62 includes a substance capable of being formed or processed at a relatively low temperature. In one exemplary embodiment, for example, in order to prevent a change in characteristic of the members of the jet assembly 54 and the printed-circuit board 52, a substance capable of deposition at below 100 degrees Celsius (° C.) is used. The substance may include parylene, but is not limited thereto or thereby. The parylene may include parylene C, parylene N, parylene D, parylene HF, etc.

The flexible layer 62 may be relatively thick to maintain mechanical characteristics such as flexibility and planarization. When the flexible layer 62 is thinner than about 0.1 micron (μm), characteristics such as flexibility and planarization are decreased. When the flexible layer 62 is thicker than about 10 μm, which increases an overall thickness of the first barrier coating film 60, a width of the jet orifice 46 and inner ink pathways is decreased having the increased thickness first barrier coating film 60 on inner walls thereof. In one exemplary embodiment, for example, a thickness of the flexible layer 62 may be about 0.1 μm to about 10 μm.

The hydrophobic layer 64 may include a hydrophobic material having a contact angle more than about 90 degrees with respect to deionized water (DI water). In one exemplary embodiment, for example, the hydrophobic material includes a contact angle of about 90 degrees to about 130 degrees with respect to deionized water (DI water). The hydrophobic layer 64 may include a self-assembled monolayer ("SAM"), but is not limited thereto or thereby. The SAM may include, but is not limited to, silane-based SAM, thiol-based SAM, etc., which include at least one silane or thiol ion.

In one exemplary embodiment, the SAM may be formed by liquid phase deposition or vapor phase deposition at a relatively low temperature. Also, the SAM may be chemically combined with the flexible layer 62, such that an adhesive strength therebetween is excellent. Furthermore, the SAM may include a relatively thin thickness below about 100 angstroms (Å).

The hydrophobic layer 64 is the top film in the first barrier coating film 60 and exposed to outside. The inks flowed through the inkjet print head directly make contact with the hydrophobic layer 64, and are transferred via one or more pathways inside of the inkjet print head. The hydrophobic layer 64 has low surface energy, thus undesirable interaction with inks which contact the hydrophobic layer 64 is not generated. The inks which flow through the inkjet head may not be absorbed, such that there is no moisture absorption on members of the inkjet head covered by the first barrier coating film 60, and may be discharged from the inkjet head through the jet orifice 46.

Hereinafter, a position of the first barrier coating film 60 will be described in detail.

Figure 4:
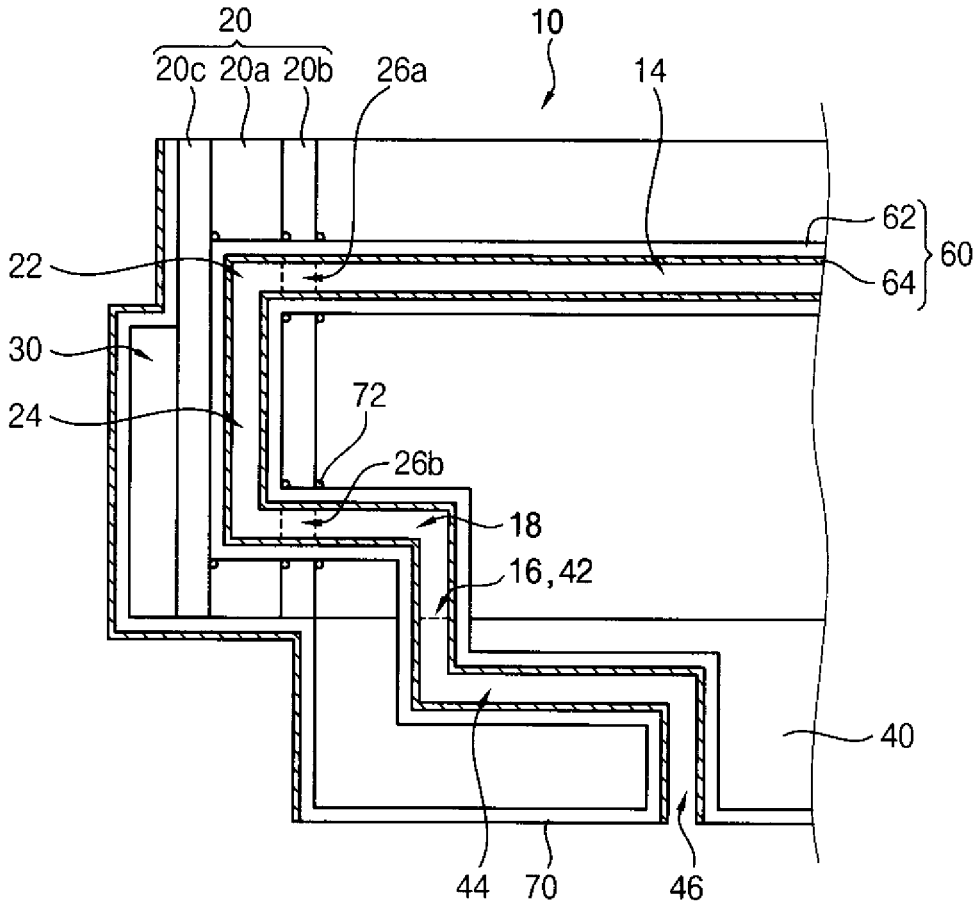
FIG. 4 is a cross-sectional view illustrating an exemplary embodiment of an ink transfer pathway relative to a barrier coating film in the inkjet print head of FIG. 1B.

FIG. 4 is a cross-sectional view illustrating an exemplary embodiment of an ink transfer pathway relative to a barrier coating film in the inkjet print head of FIG. 1B.

Referring to FIGS. 4 and 2B, the first barrier coating film 60 is disposed on an outer surface of the print head assembly 54, on inner surfaces of the ink inlet 12 of the body 10 and on inner surfaces of the ink refill pathway 14. Also, the first barrier coating film 60 is disposed on inner surfaces the ink transfer pathway within the body 10. With respect to the ink transfer pathway within the body 10, for example, the first barrier coating film 60 is disposed on inner walls of the first to third joining members 22, 24 and 26*a*, the hole 26*b*, the passage 18, the first and second openings 16 and 42, the channels 44 and the jet orifice 46. The first barrier coating film 60 may be continuous as extending from the ink refill pathway 14 to the jet orifice 46.

The body 10 of the jet assembly 50 may include carbon, silicon, etc. In one exemplary embodiment, for example, the body 10 may include carbon to prevent corrosion by inks used in the inkjet print head. However, the body 10 including the carbon is a porous media including fine holes within the body 10 and open at a surface thereof. Consequently, carbon particles may undesirably form on an outside of the body 10 such as under the influence of an externally provided pressure. As carbon particles are formed on the body 10, the carbon particles of the body 10 may be undesirably mixed with the ink from a process of jetting the ink using the inkjet print head. Thus, the ink exiting the inkjet print head may be polluted by the carbon particles. Also, the ink from a process of jetting the ink may enter into the fine holes on the surface of the body, such that the ink may be undesirably absorbed in the body 10. In addition, the ink may block or clog the jet orifice such that the jet orifice 46 may not discharge the ink.

In the illustrated exemplary embodiment, the first barrier coating film 60 on inner and outer surfaces of the body 10 covers the fine holes on the surface of the body 10. Thus, absorption or inflow of the ink into the fine holes of the body 10 may be reduced or effectively prevented, so that the pollution of the ink exiting the inkjet print head may be decreased. Also, since the ink does not contact the carbon material of the body 10, and instead contacts the exposed surface of the first barrier coating film 60, the carbon particles may not be generated by discharging the ink.

The first barrier coating film 60 is further disposed on an outer surface of the combined board assembly 20 and on inner surfaces of the first to third joining members 22, 24 and 26*a*, and the hole 26*b*. The first barrier coating film 60 is disposed on inner walls of the first and second joining members 22 and 24 in the joining board 20*a*, and on inner walls of the third joining member 26*a* and the hole 26*b* in the reinforcing board 20*b*. Thus, pollution of the inks by materials of the substrates of the combined board assembly 20, such as metals, may be decreased.

The first barrier coating film 60 is further disposed on outer surface of the piezo-electric elements 30.

The first barrier coating film 60 is further disposed on inner surfaces of the channels 44 connected between the second openings 42 and the jet orifice 46 of the nozzle plate 40.

The first barrier coating film 60 is not on the bottom surface of the nozzle plate 40. When the first barrier coating film 60 is on a surface of the nozzle plate 40, the bottom surface of the nozzle plate 40 has strong hydrophobicity due to the top hydrophobic layer 64 of the first barrier coating film 60. When the bottom surface of the nozzle plate 40 is hydrophobic, inks traveling through the channel 44 may be repelled by the bottom surface of the nozzle plate 40 and the inks may not properly exit the jet orifice 46 of the nozzle plate 40.

The first barrier coating film 60 is disposed over substantially all of the printed-circuit board 52 in FIG. 1B except for portions of the connection electrode 52*b* which extends from a portion of the printed-circuit board 52 which is connected to the jet assembly 50. The first barrier coating film 60 may serve as protective film and protects the printed-circuit board 52. Also, the first barrier coating film 60 is not coated on the connection electrode 52*b* such that the connection electrode 52*b* has electrical conductivity.

The first barrier coating film 60 covers an upper side of an adhesive member 72 such as epoxy resin, which makes contact with and is disposed between respective members of the jet assembly 50. The epoxy resin 72 may be disposed on an edge portion where the members are connected to each other. The epoxy resin 72 does not directly contact with the inks flowing through the inkjet print head due to the first barrier coating film 60. That is, the first barrier coating film 60 is between a pathway of the ink and the epoxy resin 72. Thus, pollution of the inks by materials of the epoxy resin 72 in jetting the inks from the inkjet print head may be decreased.

The second barrier coating film 70 is disposed on bottom surface of the nozzle plate 40. The second barrier coating film 70 includes only the flexible layer 62 of the first barrier coating film 60. The second barrier coating film 70 does not include any hydrophobic layer. The flexible layer 62 is continuous between the first and second barrier coating films 60 and 70, such that the flexible layer 62 may be a single, unitary, indivisible member, but is not limited thereto or thereby.

The nozzle plate 40 does not have a strong hydrophobicity property owing to the exclusion of the hydrophobic layer 64 on the bottom surface of the nozzle plate 40. Since the bottom surface of the nozzle plate 64 does not include a hydrophobic property, problems such as the inks not exiting the jet orifice 46 of the nozzle plate 40 may be reduced or effectively prevented.

In the illustrated exemplary embodiment, the first and the second barrier coating films 60 and 70 of the inkjet print head are disposed on inner and outer sides of the print head assembly 54.

The print head assembly 54 is illustrated in detail, but a structure of the print head assembly 54 is not limited to the exemplary embodiment, and may include a print head assembly 54 of other inkjet print head types.

The inkjet print head includes the first and second barrier coating films 60 and 70, such that the inkjet print head has increased durability. Also, pollution of inks discharged from the inkjet print head may be reduced or effectively prevented. Also, since the bottom surface of the nozzle plate 40 does not have a hydrophobic property, jetting of the ink from the inkjet print head is improved.

Figure 5:
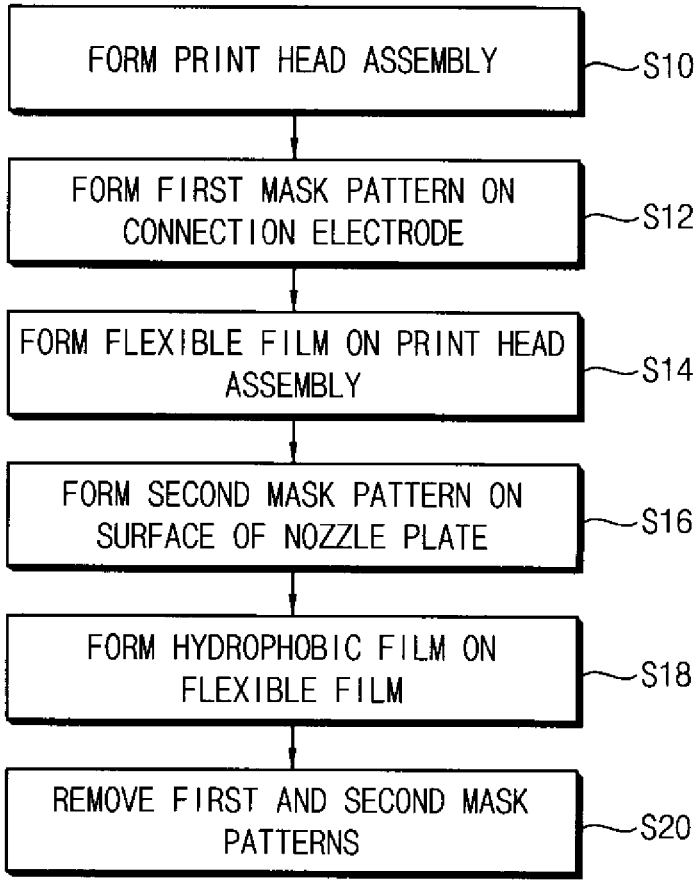
FIG. 5 is a flow chart illustrating an exemplary embodiment of a method of manufacturing the inkjet print head of FIG. 6 according to the invention.

FIG. 5 is a flow chart illustrating an exemplary embodiment of a method of manufacturing the inkjet print head of FIG. 4 according to the invention.

A print head assembly 54 is formed (S10). The print head assembly 54 is a collective assembly member thereof. A jet assembly 50 including a body 10, a combined board assembly 20, a nozzle plate 40 and a piezo-electric element 30, are combined with a printed-circuit board 52 including an integrated circuit 52*a* and a connection electrode 52*b*, to form the print head assembly 54.

A first mask pattern is formed on the connection electrode 52*b* of the printed-circuit board 52 of the print head assembly 54 (S12). The first mask pattern is provided to prevent barrier coating films from contacting the connection electrode 52*b*.

A flexible layer 62 including an organic material is formed on and in the print head assembly 54 (S14). The flexible layer 62 is formed on inner and outer surfaces of the print head assembly 54, including a bottom surface of the nozzle plate 40 and excluding the connection electrode 52*b* of the printed-circuit board 52. Thus the flexible layer 62 is formed on and in an ink transfer pathway at inner and outer surfaces of the print head.

The flexible layer 62 may be formed at a temperature below about 100° C., such as by liquid phase deposition or vapor phase deposition. In one exemplary embodiment, for example, the flexible layer 62 may be formed at about 10° C. to about 100° C. The flexible layer 62 may include parylene, but is not limited thereto or thereby. The parylene may include parylene C, parylene N, parylene D and parylene HF, etc. A thickness of the flexible layer 62 may be about 0.1 μm to about 10 μm to maintain flexibility and planarization characteristics.

A second mask pattern is formed on the bottom surface of the nozzle plate 40 of the print head assembly 54 (S 16). The second mask pattern is provided such that a hydrophobic layer 64 is not formed on the bottom surface of the nozzle plate 40.

A hydrophobic layer 64 including an organic material is formed on the flexible layer 62 (S18). The hydrophobic layer 64 may be formed on inner and outer surfaces of the print head assembly 54, except for the bottom surface of the nozzle plate 40 and the connection electrode 52*b* of the printed-circuit board 52 of the print head assembly 54.

The hydrophobic layer 64 includes hydrophobic material having a high contact angle of about 90 degrees to about 130 degrees with respect to deionized water (DI water). The hydrophobic layer 64 may be formed by liquid phase deposition or vapor phase deposition of a SAM. The SAM may include, but is not limited to, silane-based SAM, thiol-based SAM, etc. The SAM may include a thin thickness below 100 Å. When liquid phase deposition or vapor phase deposition is used in forming the hydrophobic layer 64, a process temperature may be a relatively low temperature, such as about 10° C. to about 100° C.). In one exemplary embodiment, for example the SAM may be formed at about 10° C. to about 100° C.

The first and second mask patterns are removed (S20). Thus, the flexible and hydrophobic layers 62 and 64 on the first mask pattern are removed. Also, the hydrophobic layer 64 on the second mask pattern is removed. The flexible and hydrophobic layers 62 and 64 respectively on the first and second mask patterns may be removed together and/or at substantially a same time, but are not limited thereto or thereby.

Through the above-described process, the connection electrode 52*b* of the printed-circuit board 52, and a first barrier coating film 60 including an organic material on inner and outer surfaces of the print head assembly 54 except for the bottom surface of the nozzle plate 40 are formed. Also, a second barrier coating film 70 including a flexible layer including an organic material, and not including a hydrophobic layer, is formed on the bottom surface of the nozzle plate 40.

The inkjet print head may include strong durability owing to the first and second barrier coating film 60 and 70. Also, pollution of discharged ink by materials of an adhesion member or of carbon of an inkjet print head body during jetting of the ink may be controlled.

Figure 6:
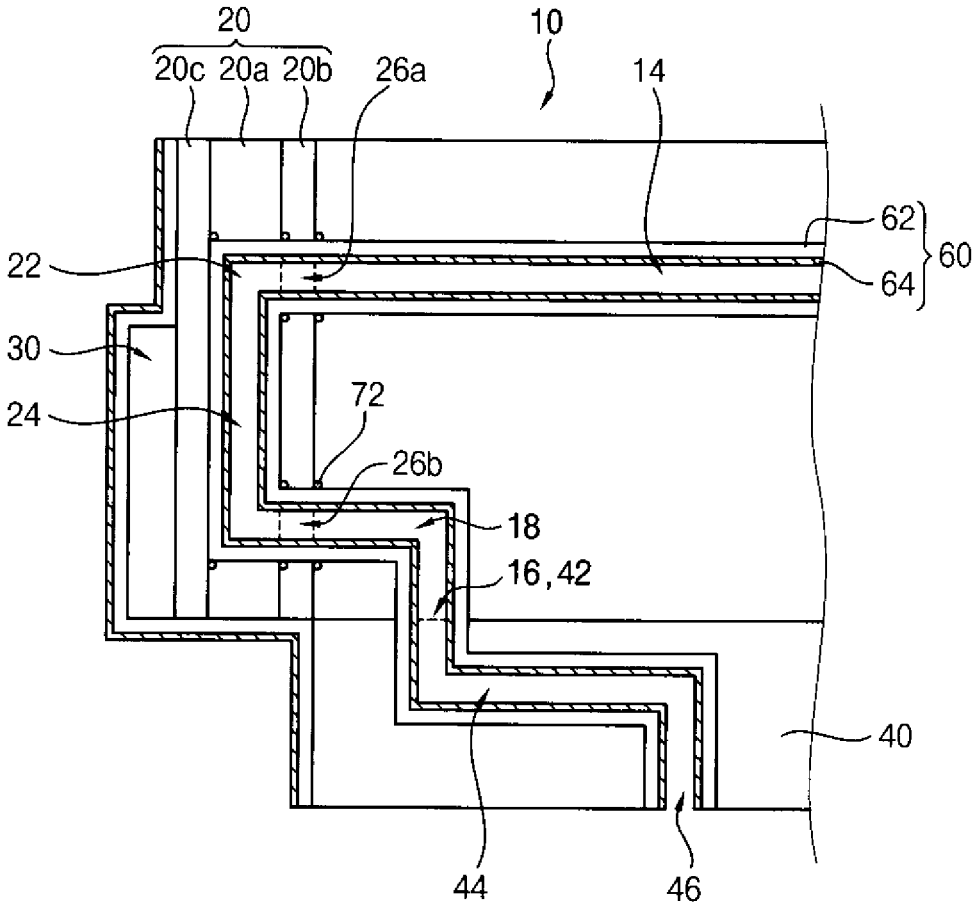
FIG. 6 is a cross-sectional view illustrating another exemplary embodiment of an ink transfer pathway relative to a barrier coating film in the inkjet print head of FIG. 1B according to the invention.

FIG. 6 is a cross-sectional view illustrating another exemplary embodiment of an ink transfer pathway and relative to a barrier coating film in the inkjet print head of FIG. 1B according to the invention.

Hereinafter, an inkjet print head illustrated in FIG. 6 may be substantially the same as the inkjet print head in FIG. 4. Also, a position of the first barrier coating film in FIG. 6 may be substantially the same as the first barrier coating film in FIG. 4. Different from the inkjet print head in FIG. 4, the inkjet print head in FIG. 6 does not include a second barrier coating film.

Referring to FIG. 6, a first barrier coating film 60 may include a flexible layer 62 and a hydrophobic layer 64, such as in a laminated structure. The first barrier coating film 60 includes substantially the same structure as the first barrier coating film 60 in FIG. 4.

A coating film is not on the bottom surface of the nozzle plate 40 in the exemplary embodiment illustrated in FIG. 6.

Even when the inkjet print head excludes a coating film on the bottom surface of the nozzle plate, since the inkjet print head includes the first barrier coating film, and thus has increased durability. Also, pollution of inks discharged from the inkjet print head may be reduced or effectively prevented. Also, since the bottom surface of the nozzle plate 40 does not includes a barrier coating film having a hydrophobicity property, jetting of the ink from the inkjet print head is improved.

Figure 7:
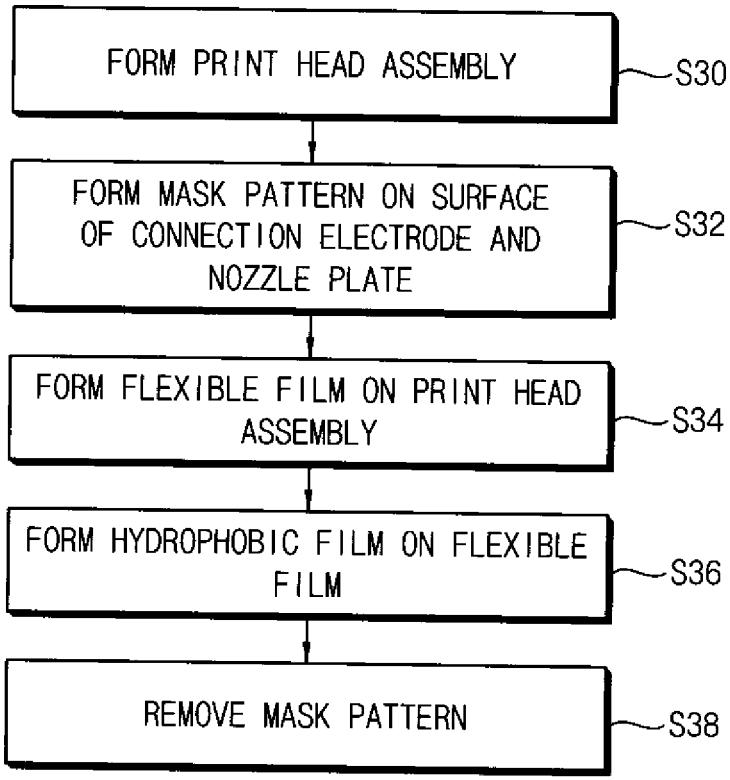
FIG. 7 is a flow chart illustrating an exemplary embodiment of a method of manufacturing a print head according to the invention.

FIG. 7 is a flow chart illustrating an exemplary embodiment of a method of manufacturing the inkjet print head of FIG. 6 according to the invention.

A print head assembly 54 is formed (S30).

A first mask pattern is formed on the connection electrode 52*b* on a printed-circuit board 52 and a bottom surface of a nozzle plate 40 (S32). The mask pattern is provided to prevent a barrier coating film from contacting the connection electrode 52*b* and the bottom surface of a nozzle plate 40.

A flexible layer 62 including an organic material is formed in the print head assembly 54 (S34). The flexible layer 62 may be formed on inner and outer surfaces of the print head assembly including the mask pattern. The flexible layer may be formed on inner and outer surfaces of the print head assembly 54, except for the bottom surface of the nozzle plate 40 and the connection electrode 52*b* of the printed-circuit board 52.

The flexible layer may be formed by liquid phase deposition or vapor phase deposition, but is not limited thereto or thereby. In one exemplary embodiment, for example, the flexible layer 62 may be formed at a temperature of about 10° C. to about 100° C. The flexible layer 62 may include parylene, but is not limited thereto or thereby. The parylene may include parylene C, parylene N, parylene D and parylene HF, etc. A thickness of the flexible layer 62 may be about 0.1 μm to about 10 μm to maintain flexibility and planarization characteristics.

A hydrophobic 64 including an organic material is formed on the flexible layer 62 (S36).

The hydrophobic layer 64 includes hydrophobic material having a high contact angle of about 90 degrees to about 130 degrees with respect to deionized water (DI water). The hydrophobic layer 64 may be formed by liquid phase deposition or vapor phase deposition of a SAM. The SAM may include, but is not limited thereto or thereby, silane-based SAM, thiol-based SAM, etc. The SAM may include a thin thickness below 100Å. When liquid phase deposition or vapor phase deposition is used in forming the hydrophobic layer 64, a process temperature may be a relatively low temperature, such as about 10° C. to about 100° C. For example the SAM may be formed at about 10° C. to about 100° C.

The mask patterns are removed (S38). Thus, the flexible and hydrophobic layers on the mask pattern may be removed separately or together. Thus, a barrier coating film is not formed on the bottom surface of the nozzle plate 40 and the connection electrode 52*b* of the printed-circuit board 52.

The inkjet print head formed from the above-described process may include strong durability owing to the barrier coating film. Also, pollution of the inks by materials of an adhesion member or of carbon of an inkjet print heat body during jetting of the ink may be controlled.

As a first comparative experiment, a conventional inkjet print head not including a barrier coating film and an exemplary embodiment of inkjet print head including barrier coating film according to the invention were used, and a purity of the inks discharged from each inkjet printer was measured.

Purity in percent (%) of ink with respect to each sample was measured after exchanging the ink from the inkjet printer to the respective inkjet print head. The inkjet printer used in the experiment was a printer for manufacturing liquid crystal in a liquid crystal display device ("LCD"), and the ink used is the liquid crystal.

Figure 8A:
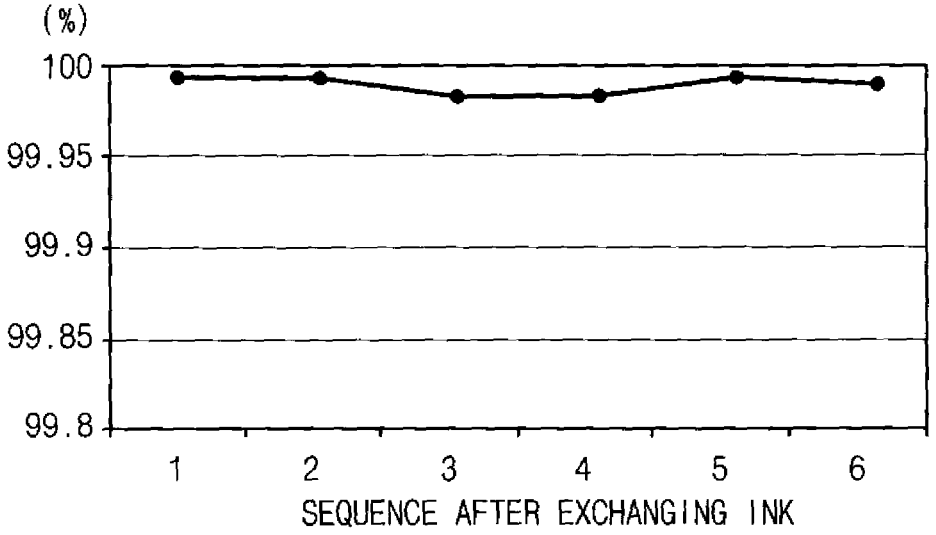
FIG. 8A is a graph illustrating a purity of discharged ink in percent (%) of sequential uses for the inkjet print head including a barrier coating film and manufactured by the method of FIG. 5.
Figure 8B:
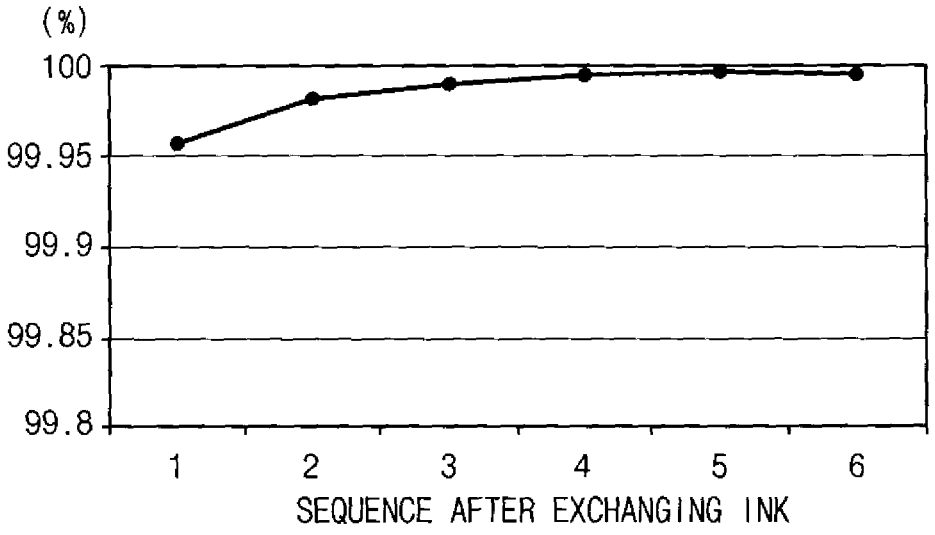
FIG. 8B is a graph illustrating a purity of discharged ink in percent (%) sequentially jetted through a conventional inkjet print head without a barrier coating film.

FIG. 8A is a graph illustrating a purity of discharged ink when an exemplary embodiment of an inkjet print head according to the invention is used. FIG. 8B is a graph illustrating a purity of discharged ink when a conventional inkjet print head excluding a barrier coating film is used.

Referring to FIG. 8A, when an exemplary embodiment of an inkjet print head according to the invention is used, an ink jetting process is performed after exchanging an ink for a different ink in an inkjet print head, and a purity of discharged inks is nearly 100%. Also, the ink jetting process is performed for subsequent samples, but the purity of discharged inks is not significantly decreased, so that the purity is maintained substantially at about 100%.

In the exemplary embodiment of the inkjet print head according to the invention, a portion of the inkjet print head including a hydrophobic layer having hydrophobicity on an inner surface thereof directly makes contact with the inks, so that there is substantially no negative interaction between the inks and the inner surface of the inkjet print head. Thus a purity of the inks discharged from the inkjet print head including the hydrophobic layer is very high. Particularly, moisture absorption by surfaces of the inkjet print head after exchanging the ink is effectively prevented.

Thus, when the purity of the inks discharged from the inkjet print head including the hydrophobic layer is very high, a test-printing process is not necessary after exchanging an ink, and a real (e.g., non-test) printing process may be performed immediately after exchanging the ink. Thus, a process cost of the test-printing process may be decreased.

Referring to FIG. 8B, when the conventional inkjet print head not including the barrier coating film is used, an ink jetting process is performed after exchanging an ink in an inkjet print head, but a purity of discharged inks is decreased to as much as only 99.95%. When the ink jetting process is performed for a subsequent sample, a purity of discharged inks is not significantly increased. To significantly increase the purity of the discharged inks, the ink jetting process must be performed to a number of samples.

In the conventional inkjet print head, a surface of the inkjet print head directly makes contact with inks, so that there is an undesirable interaction between the inks and the surface of the inkjet print head. Thus a purity of the inks is decreased in the conventional inkjet print head. For example, moisture absorption by surfaces of the inkjet print head may occur after exchanging an ink. Thus, when the purity of the inks discharged from the conventional inkjet print head excluding the hydrophobic layer is very low, a test-printing process must be performed after exchanging an ink, for a number of times, before a real printing process may be performed. Thus, process cost of the test-printing process may be undesirably increased.

As a second comparative experiment, a conventional inkjet print head not including a barrier coating film and an exemplary embodiment of an inkjet print head including a barrier coating film according to the invention were used, and a fraction of defective nozzles of each inkjet print head was measured. The inkjet printer used in the experiment was a printer for manufacturing liquid crystal in a LCD, and the ink used the liquid crystal.

In order to accelerate experiments, an ink jetting process was performed for a few days by exchanging an ink in the inkjet print heads in an oven at 80° C. A fraction of defective nozzles of each inkjet print head was measured and the results are summarized below in Table 1. The total number of nozzles used is two hundred fifty-six pieces in the experiment.

TABLE 1

| | elapsed time (35 days) | elapsed time (50 days) |
|---|---|---|
| Conventional print head | 3 nozzles undischarged | 6 nozzles undischarged |
| Print head of the invention | Non undischarged | Non undischarged |

In Table 1, when the conventional inkjet print head not including a barrier coating film was used, undischarged or clogged nozzles were generated after 35 days.

However, when the exemplary embodiment of an inkjet print head including barrier coating film according to the invention was used, undischarged or clogged nozzles were not generated even after 50 days.

It can be observed from the above-described second comparative experiment, when the exemplary embodiment of an inkjet print head including a barrier coating film according to the invention was used, a performance period was lengthened. Thus, a durability of the inkjet print head according to the invention is increased.

According to one or more exemplary embodiment of the invention, an inkjet print head has increased durability, and decreases pollution of the inks flowing through the inkjet print head. The inkjet print head may be used in the process of manufacturing a liquid crystal display device, but is not limited thereto or thereby.

The foregoing is illustrative of the invention and is not to be construed as limiting thereof. Although a few exemplary embodiments of the invention have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. In the claims, means-plus-function clauses are intended to cover the structures described herein as performing the recited function and not structural equivalents but also equivalent structures. Therefore, it is to be understood that the foregoing is illustrative of the invention and is not to be construed as limited to the specific exemplary embodiments disclosed, and that modifications, are intended to be included within the scope of the appended claims. The invention is defined by the following claims, with equivalents of the claims to be included therein.

What is claimed is:

1. An inkjet print head comprising:

a jet assembly comprising:

a nozzle plate comprising:

a jet orifice defined in a lower surface of the nozzle plate and through which an ink is discharged from the nozzle plate, and an ink transfer pathway inside the nozzle plate;

a printed-circuit board which is combined with the jet assembly, the printed-circuit board comprising:

a portion which extends directly from and is exposed from the jet assembly, on which an integrated circuit is disposed; and a connection electrode which is connected to the jet assembly via the portion of the printed circuit board which extends from and is exposed from the jet assembly;

a first barrier coating film comprising an organic material, a flexible layer and a hydrophobic layer; and a second barrier coating film comprising only the flexible layer among the flexible layer and the hydrophobic layer of the first barrier coating film, wherein the flexible layer and the hydrophobic layer of the first barrier coating film covers inner and outer surfaces of the jet assembly, and an outer surface of the printed-circuit board portion which extends directly from and is exposed from the jet assembly, the hydrophobic layer of the first barrier coating film covers inner and outer surfaces of the jet assembly except for the lower surface of the nozzle plate and the connection electrode of the printed-circuit board, and the flexible layer of the second barrier coating film covers the lower surface of the nozzle plate.

2. The inkjet print head of claim 1, wherein the flexible layer of the first barrier coating film comprises a parylene film.

3. The inkjet print head of claim 2, wherein the parylene film comprises at least one selected from parylene C, parylene N, parylene D and parylene HF.

4. The inkjet print head of claim 1, wherein a thickness of the flexible layer is about 0.1 micron to about 10 microns.

5. The inkjet print head of claim 1, wherein the hydrophobic layer comprises a self assembly monolayer.

6. The inkjet print head of claim 1, wherein the hydrophobic layer comprises a material having a contact angle of about 90 degrees to about 130 degrees with respect to deionized water.

7. The inkjet print head of claim 1, wherein a thickness of the hydrophobic layer is about 30 angstroms to about 100 angstroms.

8. The inkjet print head of claim 1, wherein the first barrier coating film further covers an inner surface of the ink transfer pathway, and an inner surface of the jet orifice from the ink transfer pathway to the lower surface of the nozzle plate.

9. The inkjet print head of claim 1, wherein the first barrier coating film covers all jet assembly inner surfaces which contact the ink.

10. The inkjet print head of claim 1, wherein the flexible layer of the first barrier coating film covering the inner surfaces of the jet assembly, is continuous with the flexible layer of the second barrier coating film covering the lower surface of the nozzle plate as an outer surface of the jet assembly.

11. The inkjet print head of claim 1, wherein the jet assembly further comprises a body to which the nozzle plate is connected and in which an inkjet refill pathway is defined, the inkjet refill pathway of the body is in fluid connection with the ink transfer pathway of the nozzle plate, and the flexible layer and the hydrophobic layer of the first barrier coating film covers inner surfaces of the ink refill pathway.

* * * * *